United States Patent [19]

Tenorio et al.

[11] Patent Number: 4,834,282

[45] Date of Patent: May 30, 1989

[54] DEVICE FOR USE WITH FLUE DAMPERS

[76] Inventors: Abel Tenorio, P.O. Box 48, Kyle, Tex. 78640; Ernest Sanchez, 1168 Live Oak Loop, Buda, Tex. 78610; Stephen I. Adler, 202 W. 13th St., Austin, Tex. 78701

[21] Appl. No.: 18,402

[22] Filed: Feb. 25, 1987

[51] Int. Cl.[4] ..... F24F 13/10

[52] U.S. Cl. ..... 236/1 G; 137/523; 251/285; 236/49.5

[58] Field of Search ..... 236/1 G, 49 D; 431/20; 126/285 B, 292; 251/285, 287; 137/523

[56] References Cited

U.S. PATENT DOCUMENTS

| | | | |
|---|---|---|---|
| Re. 31,112 | 12/1982 | Prikkel, III | 236/1 G |
| 2,179,120 | 11/1939 | Firehammer | 126/285 B |
| 2,937,697 | 5/1960 | Johnston | 431/20 |
| 4,021,187 | 5/1977 | Schulte et al. | 431/20 |
| 4,046,318 | 9/1977 | Ripley | 236/1 G |
| 4,079,884 | 3/1978 | Sherman | 236/1 G |
| 4,237,855 | 12/1980 | Shea | 126/285 B |
| 4,281,638 | 8/1981 | Delany | 126/428 |
| 4,383,641 | 5/1983 | Shreve | 236/49 |
| 4,394,958 | 7/1983 | Whitney et al. | 236/49 |
| 4,399,940 | 8/1983 | Stiles | 236/1 G |
| 4,413,613 | 11/1983 | Dunlap | 126/292 |
| 4,439,139 | 3/1984 | Nelson et al. | 431/20 |

*Primary Examiner*—William E. Tapolcai

*Attorney, Agent, or Firm*—Reid G. Adler; Carolyn R. Adler

[57] ABSTRACT

A device is provided for controlling the position of a damper within a flue or stack of a forced air heating or cooling system or a commercial or industrial boiler. The device comprises a damper plate and means to control rotation of the plate within a flue under force supplied by the movement within the flue of air or gases.

8 Claims, 1 Drawing Sheet

DEVICE FOR USE WITH FLUE DAMPERS

FIELD OF THE INVENTION

This invention relates to devices for controlling the dampers of flues such as are found in residential and commercial forced air heating and cooling systems.

BACKGROUND OF THE INVENTION

To maximize energy conservation, it is desirable to prevent the loss of heat which escapes through flues such as are found in residential and commercial chimneys, industrial boilers, forced air heating and cooling systems and combustion chambers which vent waste gases. It has been reported that up to 90% of the fuel burned for energy for heating or power purposes can be lost by heat escape through air convection currents moving up and exiting out through improperly damped flues. Similarly, it is desirable to control temperatures on a room-by-room basis in homes and offices which employ forced air heating or cooling systems. Numerous devices have been proposed and utilized to control the flow of hot air, cold air and combustion gases through the positioning of dampers mounted within a flue or stack associated with combustion, heat producing or cold-air producing units.

Dampers which fit within a flue or duct are well known in the heating art. At a relatively simple technological level exist those damper apparatuses in which a damper plate is rotatably mounted on a shaft which extends outwardly of the exterior of the flue to be damped and the damper shaft is rotated manually to open or close the flue. See for example, U.S. Pat. No. 4,413,613 to Dunlap.

A more complex approach is reflected in U.S. Pat. No. 4,046,318 to Ripley which discloses an automatic boiler damper activated by a solenoid valve attached to the pivot axis of a damper that is positioned within a stack utilized to vent a heating system. This solenoid is electrically activated upon the appropriate signal from a thermostat secured to a flue, or stack, immediately over the position of the damper assembly. The damper is provided with a vent hole through which heated stack gases flow in sufficient quantity upwardly from the damper in its closed position to activate the thermostat and signal the damper to move to its open position, thereby venting stack gases out through the stack. Heat is conserved in this manner because the damper is closed when the boiler is not being heated, and cold drafts are simultaneously prevented from entering the stack as a downdraft U.S. Pat. No. 4,237,855 to Shea discloses a related structure intended to throttle the flue to a bare minimum during the period in which the heat source is on, thereby slowing the escape of heat leaving the heat exchanger (i.e., boiler or furnace) and thereby causing it to retain and utilize more heat than the heat exchanger otherwise could. As illustrated, the heating source is wired in parallel with the activating solenoid that ultimately controls the damper position. When the solenoid is energized it lifts the solenoic draw bar which in turn raises a linkage, thereby indirectly rotating a shaft and attached flue damper.

Other patents disclose improved electrical control systems associated with the use of solenoid-activated flue damper operating mechanisms. Thus, for example, U.S. Pat. No. 4,021,187 to Schulte et al. also discloses a solenoid flue gate device, and a series of relay switches which regulate the energizing and deenergizing of the solenoid. The pull of the solenoid itself is resisted by a spring which restores the flue damper to an open position when the solenoid is deenergized or power is lost through an electrical failure, thus enabling a fail safe condition.

Other efforts have been directed to the use of damper this class of device is U.S. Pat. No. 4,281,638 to Delaney which discloses a solar heating system having a motor connected to a suitable electricity source, the motor rotating a damper blade between an open horizontal position and a fully closed position. The Delaney patent teaches that any well-known damper motor may be utilized, and is essentially directed to an improved motorized damper assembly which is intended to minimize the disadvantageous effects of damper blade warping or improper sealing. Alternatively, U.S. Pat. No. 4,039,123 to Frankel utilizes an electric motor having a rotary output shaft to engage a vane shaft which rotates to adjust to the position of a damper within the heating flue. Similarly, U.S. Pat. No. 4,439,139 to Nelson et al. teaches the use of a furnace stack damper control apparatus with a motor connected to the stack damper.

In some applications, it may be particularly desirable to regulate the flow of flue gases and the movement of heat from a combustion chamber by automatic stove dampers or draft inlets that do not require manual attention or the motor driven or solenoid operated attachments as discussed above. Accordingly, it is known in the art to utilize automatic dampers comprising a bimetallic element placed either within or in close proximity to a furnace flue so that the increased temperature of flue gases during combustion deforms the bimetallic element and thereby regulates the position of the damper plate within the flue. Such a damper control is advantageous in that it can be adjusted to produce a graduated response over a range of temperatures and may thereby permit more fine control of combustion and heating.

To this achieve this automatic control approach end, U.S. Pat. No. 4,399,940 to Stiles discloses an automatic stove damper having a temperature responsive element that activates a damper plate. A mechanism for facilitating adjustment of the relative amount of damping provided by the device is disclosed as well as a manual adjustment means which can release the temperature responsive element to quickly shift the damper plate to a fully damped position. The Stiles patent teaches that this feature is desirable in order to enhance the control by the operator of this heating system.

Other types of known devices respond to the movement of air in a system rather than to the temperature of this medium. For example, the Honeywell brand "Sail Switch" is operated by an aluminum sail which can be inserted into an air stream. The movement of air either makes an electrical circuit or breaks a circuit in response to increased air velocity in a forced air duct.

None of the foregoing, however, teach the use of an inexpensive, easily assembled electromechanical device which requires only sufficient electrical power to operate a solenoid associated with a control lever that indirectly regulates movement of a damper for which the motive rotational power is supplied by the movement of hot air, cold air or combustion gases within a flue.

SUMMARY OF THE INVENTION

It is an object of the present invention to provide a device for controlling the movement of gases through a flue which comprises a damper plate rotatably mounted within the flue for rotation between open and closed positions under the force supplied by the movement of gases within the flue. This device also includes a means for controlling rotation of the damper plate through incremental angles of rotation.

It is a further object of the present invention to provide a novel device for controlling the movement of gases in a flue in which a damper plate further includes a damper shaft which extends outwardly through the flue wall. The shaft has spaced apart first and second pins extending through the shaft but perpendicular to each other and to the shaft. The controlling means comprises a stop lever which is reversibly movable between a first position and a second position In its first position the lever engages the first pin of the shaft to effectively block rotation of the shaft. In its second position, the stop lever engages the second pin and effectively blocks rotation of the shaft as well. The movement of this stop lever in either direction between its first and second positions effectively allows about a 90 degree rotation of the shaft, which corresponds to a movement of the damper plate from a position which blocks the flow of air or gases in the flue to a position which is effectively open and allows air or gas to easily flow through The objects of the present invention are further satisfied by the use of a controlling device which further comprises electrically actuated means for controlling the movement of the stop lever, as for example by the use of a solenoid and associated biasing spring to control the movement of the stop lever.

In a further aspect of the present invention, the foregoing objects are satisfied by providing controlling means responsive to a thermostat or thermostat system so that the thermostat or system triggers the controlling means to rotate the damper shaft and damper between open and closed positions when the thermostat registers a preset temperature.

Yet another aspect of the present invention is provided by a kit for installing the foregoing devices into an existing flue through a suitable elongated slot transverse to the flue's longitudinal axis. The kit comprises a cover which corresponds in configuration to the material removed from the flue to leave the slot, the slot being large enough to allow the damper to be placed into an effective position with the flue. The cover is slightly larger than the slot so as to fit against the slot opening and thereby seal it. With this kit, a means for fastening the damper plate and damper shaft to the cover is provided as well as a means for fastening the cover to the flue. The accompanying drawings, which are incorporated in and constitute a part of this specification, illustrate two embodiments of the invention and, together with the description, serve to explain the principles of the invention.

DETAILED DESCRIPTION OF THE INVENTION

Figure 1:
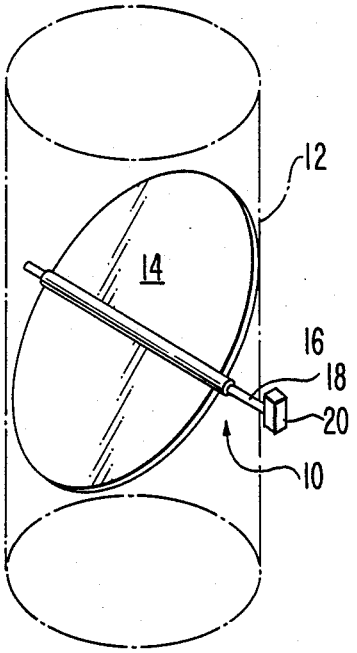
FIG. 1 is a perspective view of the basic elements of the device for controlling movement of gases in a flue of the present invention.

Referring now to the illustration of the preferred embodiments in the drawings, in which similar parts of the invention are identified by the same reference numerals, there is seen in FIG. 1 a device 10 for controlling the movement of gases through a flue 12 shown in phantom in FIG. 1. The major components of the device of the present invention include a damper plate or vane 14 which is fixedly mounted to a damper shaft or axle 16 about which the damper plate 14 spins or rotates within the flue 12, and an external shaft portion 18 of shaft 16 which extends outwardly through flue 12 and is coupled to a controlling means assembly 20, represented in FIG. 1 only by a box-like structure.

Although the embodiments discussed in this application are illustrated in conjunction with an essentially cylindrical flue, the flue may be of circular or rectangular or other cross-sectional configuration so long as the corresponding element of this device, i.e., damper plate 14, is configured so as to allow movement of the damper between positions which effectively block and effectively allow movement of air or gases through the flue.

Figure 2:
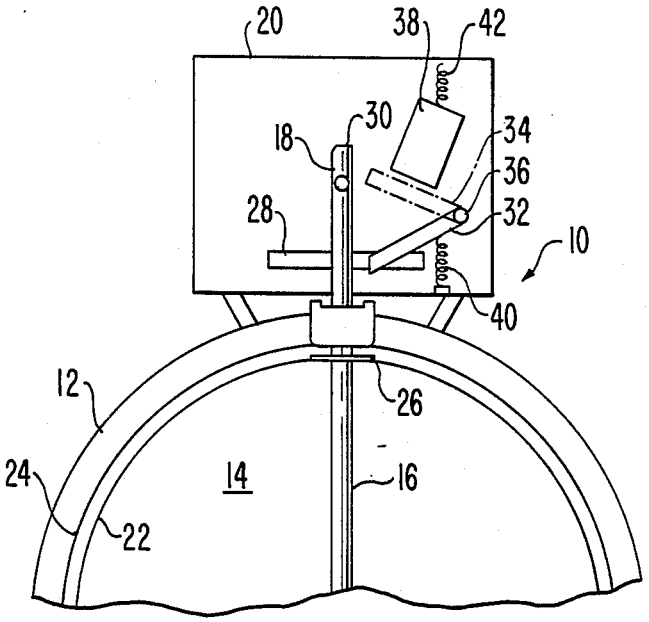
FIG. 2 is a diagrammatic sectional view of one embodiment o the present invention.

Referring now to one embodiment of the present invention as described in FIG. 2, there is shown a flue 12, inside of which is shown damper plate 14 and its associated damper shaft 16. An external shaft portion 18 of the damper shaft 16 is shown within the housing of a controlling means assembly unit 20. One skilled in the art will note that the diameter of damper plate 14 is less than but approximately equal to the inner diameter of flue 12 such that the outer peripheral edge 22 of plate 14 lies in spatial approximation to inner wall 24 of flue 12 sufficient to effectively block the flow of gases in flue 12 when the damper plate 14 is rotated by the force of a flow of moving hot or cold air or combustion gases into a position to block the flow of air or gases in the flue. A bushing 26 (not shown in FIG. 1) allows free rotation of shaft 16–18 in response to the flow of gases and under control of controlling means assembly 20. An appropriate bushing or other component& or modification is preferably selected in order to limit the rotation of the damper shaft to one direction only. Thus, it is contemplated that a circular damper of seven inch diameter, for example, will preferably have its opposite edges folded inwardly about 1 inch from the peripheral edge toward the center of the damper at about a 45 degree angle with each fold being made toward opposite sides of the damper. Thus, one edge folds upwardly relative to the other edge which folds downwardly. This configuration biases the rotation of the damper so that air flow tends to rotate the damper in one direction only. The exact dimensions of such folds and their specific angle are not critical, rather appropriate configurations should be adapted to the specific air flow parameters of a specific installation.

External portion 18 of shaft 16 terminates within assembly 20. A first pin 28 and a second pin 30 are configured in a spaced-apart manner such that pins 28 and 30 penetrate perpendicularly through external shaft 18 and pins 28 and 30 further are mutually perpendicular. As illustrated in FIG. 2, pin 28 lies within the plane of damper plate 14 and pin 30 is perpendicular to the foregoing plane and is seen in FIG. 2 from an end-on perspective.

A stop lever 32 is shown in its first position within assembly 20 in contact with first pin 28 of external shaft 18. As will be evident to one skilled in this art, stop lever 32 in its first position as shown indirectly prevents rotation of damper plate 14 by limiting or stopping the movement of first pin 28. In its second position, illustrated in FIG. 2 in phantom at element 34, the movement of damper plate 14 is similarly controlled by stopping the movement of second pin 30. Stop lever 32 swings between its first and second positions by pivoting about a pivot 36. The movement of stop lever 32 is under the control of a solenoid 38 and a biasing means such as spring 40.

For maximally effective control of the damper plate within the flue, various component devices may be utilized in order to permit rotation of the plate about the damper shaft axis in only one direction. Such modifications and embellishments are well within the knowledge of those skilled in this art.

Solenoid 38 is shown in FIG. 2 as coupled to electrical wires 42 which represent electrical linkage of controlling means assembly 20 to a thermostat, thermostat system or other directing or controlling means external to the illustrated device. Representative thermostat or external controlling systems are illustrated, as examples, by U.S. Pat. No. 4,005,820, 4,021,187 and 4,439,139, the disclosures of which are incorporated herein by reference in their entireties.

Figure 3:
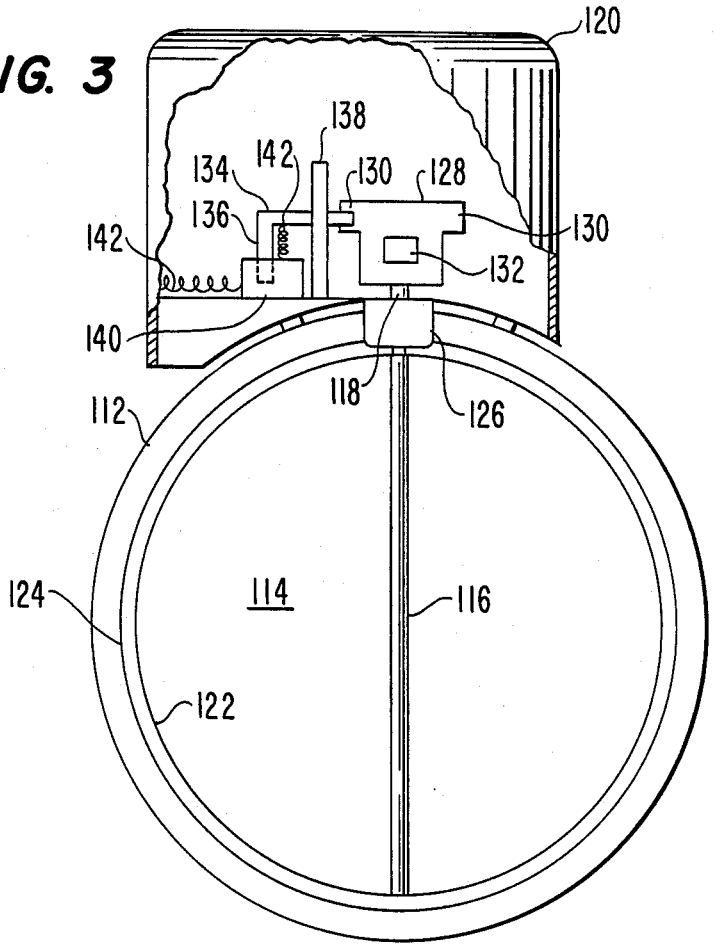
FIG. 3 is a diagrammatic partial cut-away sectional view of a second embodiment of the present invention

A second embodiment of a device of the present invention is illustrated in FIG. 3. A flue 112 is shown having internally thereof damper plate 114 and damper plate shaft 116. Shaft 116 has an external shaft portion 118 outside of flue 112 which terminates within controlling means assembly unit 120. As in the embodiment of FIG. 2, damper plate 114 has an continuous peripheral edge 122, the diameter of plate 114 being sufficient to bring edge 122 into approximation with internal wall 124 of flue 112 effective to control the movement of air or gases within the flue. Shaft 116 penetrates through flue 112 through a bushing 126.

External shaft portion 118 terminates in a cap 128 having attached to or formed thereupon a first prong 130 mutually perpendicular to a second prong 132. In FIG. 3, first prong 130 lies in the plane defined by damper plate 114 and second prong 132 extends perpendicularly behind and out from this plane. A stop rod 134 having a right-angled arm 136 moves within the slot of a slotted guide 138 between first and second positions along the axis defined by shaft 116 and external shaft portion 118 to regulate the revolution of cap 128 and, indirectly, damper plate 114. The movement of stop rod 134 within guide 138 is controlled by a solenoid-type device 140 acting upon arm 136 and bias means such as spring 142 acting upon rod 134. The control of this unit is preferably responsive to an external thermostat assembly, represented by 142, as described above for the embodiment of FIG. 2.

The operation of the foregoing embodiments is generally described as follows. The purpose of the device is to provide control of the movement of hot or cold air or combustion gases within a flue. Additionally, this device is useful for providing a desired amount of air flow to each room or area within a building having central air conditioning or central heat systems. In this latter application, a thermostat mounted in each room or area will cause the damper device associated with that room or area's air vent to open or close under the force of moving hot or cold air or combustion gases. When the desired temperature in a given room or area is at the selected level, the damper will be caused to close, thereby forcing the movement of more air to the rooms or other areas where additional air flow is needed to effect the proper temperature. Accordingly, this system can provide an almost optimal air temperature balance between rooms and is in a dynamic balance which adjusts for the changing locations of solar heat and for the opening or closing of curtains or blinds over windows in individual rooms. Such a system additionally operates automatically, thereby eliminating the need for manual operation of louvers or vents as is conventional.

The system preferably operates with a low-voltage transformer to provide power to multiple thermostats in the various rooms or areas within a residence or other building. Using appropriate relays, the individual thermostat in a room or area will cause rotation of the damper plate within the flue to open or close and thereby regulate the air flow through the flue which empties into a given room through its air vent.

The device of the present invention can be installed in a variety of ventilation and boiler or combustion systems. In a residential application, the device is preferably emplaced in a housing behind and in close proximity to the air vent at the end of the duct work leading into that room. Therefore, the device would be situated behind the room's wall and thereby obscured from view. Air movement from the duct into the room will cause the damper to spin, and appropriate configuration of the damper plate and shaft to achieve this responsiveness to air flow can be achieved by conventional means. Other preferred sites of installation include the plenum attached to the air blower in a central heat or air conditioning system, or in trunk lines off of the main or major trunk duct lines. It is particularly contemplated that the device of the present invention be installed into existing flue, duct and ventilation systems. To this end, procedures and devices may be used such as are disclosed, for example, by U.S. Pat. No. 4,413,613, the disclosure of which is hereby incorporated herein by reference in its entirety.

It is contemplated that the pins, as described in FIG. 2, will be spaced-apart by about a one-half inch distance, although this absolute distance is not critical The accompanying control means such as the stop lever which interacts with these pins must therefore be sized in a manner effective with the particular selections of pin length and spaced apart distance in a given installation.

When the stop lever is in its initial position, the lever will stop the damper plate via the pin from turning. Charging or discharging the associated solenoid-type device either retains the stop lever in its present position or allows the associated spring biasing device to move the lever to its second position. The damper plate through the damper shaft will thus be allowed to turn about 90 degrees under the force of flowing air until the second pin on the external portion of the damper shaft comes into contact with the stop lever in its second position. For residential heating and cooling purposes, it is contemplated that the rest position of the damper of the device will be open. For commercial applications, as in industrial boilers, it may be preferable to configure the device so that the rest position in the unenergized state of the damper of the device will be closed, thereby contributing to the desired retention of heat in the heat exchanger.

It is contemplated that other features and refinements of the present invention may be incorporated to enhance the durability or attractiveness of the claimed invention. For example, the paired perpendicular pins or prongs as described above need not be spaced apart and can be configured so that both pairs of pins or prongs are effectively rotating in the same plane about the damper shaft. In such an embodiment, the stop lever assembly would move in and out of the rotation plane of the pins or prongs such that ninety degree rotations of the damper shaft are permitted. What is essential is that means be provided for limiting the rotation of the damper within the flue. Other configurations of pins and levers are also contemplated in which finer control of damper rotation is provided by permitting and controlling shaft rotation through increments of less than ninety degrees. Also contemplated as being encompassed by the present invention are fully electronic analogs of the essentially mechanical embodiments described above.

It will be apparent to those skilled in the art that various modification and variation can be made in the overall size and relative configurations of the component parts described above without departing from the scope or spirit of the invention. Thus, it is intended that the present invention cover modification and variations of this invention provided that they come within the scope of the appended claims and their equivalents.

What is claimed is:

1. A device for controlling the movement of gases through a flue, comprising:

a damper plate rotatably mounted within the flue for rotation between open and closed positions under the force supplied by movement of gases within the flue, said damper plate including a damper shaft extending out through the flue and having a spaced apart first and second pin extending therethrough, said pins being configured perpendicularly to each other and to said shaft; and means for controlling rotation of said damper plate through incremental angles of rotation, said controlling means comprising a stop lever reversibly movable between a first and second position, said lever in its first position engaging said first pin to block rotation of said shaft and in its second position engaging said second pin to block rotation of said haft; and the movement of said lever in either direction between its said first and second positions allowing a ninety degree rotation of said shaft.

2. The device of claim 1, further comprising electrically actuated means for controlling movement of said stop lever.

3. The device of claim 2, wherein said controlling means is responsive to a thermostat such that said controlling means is triggered to allow rotation of said damper to its said closed position when said thermostat registers a preset temperature.

4. A kit for installing the device of claim 1 into a transverse slot provided in an elongated flue transverse to the flue's longitudinal axis without cutting completely through the flue, said kit comprising:

a cover conforming to the transverse slot and sized slightly larger than the slot, said cover being adapted to fit against the slot and thereby seal it;

a damper plate rotatably mounted about a damper shaft for rotation within the flue, said damper shaft mounted to and extending out through said cover and having spaced apart first and second pins extending therethrough, said pins being configured perpendicularly to each other and to said shaft, said damper plate adapted for rotation between open and closed positions under the force supplied by movement of air or gases within the flue;

means for controlling rotation of said damper plate through incremental angles of rotation comprising a stop lever reversibly movable between a first and second position, said lever in its first position engaging said first pin to block rotation of said shaft and in its second position engaging said second pin to block rotation of said shaft, and the movement of said lever in either direction between its said first and second positions allowing a ninety degree rotation of said shaft;

means for fastening said cover to the flue; and means for connecting said rotational controlling means to an external thermostat.

5. The device of claim 1, wherein said damper further comprises at least one edge inwardly folded so as to effectively bias the direction of rotation of said damper under said force supplied by movement of gases within the flue.

6. The device of claim 2, wherein said controlling means is responsive to a thermostat such that said controlling means is triggered to allow rotation of said damper to its said open position when said thermostat registers a preset temperature.

7. A device for controlling the movement of gas through a flue comprising:

a damper plate assembly including a damper plate and mounting means for rotatably mounting said damper plate to rotate freely in one direction through open and closed positions in response to the flow of gas in a single direction against said damper plate, said damper plate being effective to restrict the flow of gas in the closed position but to permit unrestricted flow of gas in the open position; and control means operative to stop the free rotation of the damper plate selectively in the closed and open positions.

8. The device of claim 7, wherein said free rotation of said damper plate occurs through a 360° angle.

* * * * *